US005188167A

United States Patent [19]

Perry et al.

[11] Patent Number: 5,188,167

[45] Date of Patent: Feb. 23, 1993

[54] CONTINUOUS CASTING MOULD

[75] Inventors: Robert M. Perry, Whitehaven; Timothy Reynolds, Cockermouth, both of England

[73] Assignee: Davy (Distington) Limited, Great Britain

[21] Appl. No.: 623,754

[22] PCT Filed: Jun. 16, 1989

[86] PCT No.: PCT/GB89/00677

§ 371 Date: Jan. 29, 1991

§ 102(e) Date: Jan. 29, 1991

[87] PCT Pub. No.: WO89/12516

PCT Pub. Date: Dec. 28, 1989

[30] Foreign Application Priority Data

Jun. 16, 1988 [GB] United Kingdom ..... 8814331

[51] Int. Cl.[5] ..... B22D 11/04

[52] U.S. Cl. ..... 164/418; 164/459

[58] Field of Search ..... 164/418, 459

[56] References Cited

U.S. PATENT DOCUMENTS 4,635,702 1/1987 Kolakowski et al. ..... 164/418
4,774,995 10/1988 Fastert ..... 164/418
4,926,930 5/1990 Gay et al. ..... 164/418

FOREIGN PATENT DOCUMENTS 62-6737 1/1987 Japan ..... 164/418

*Primary Examiner*—Kuang Y. Lin
*Attorney, Agent, or Firm*—Lee, Mann, Smith, McWilliams, Sweeney & Ohlson

[57] ABSTRACT

A continuous casting mould for casting thin slabs has, at its inlet end, a mould cavity which has generally rectangular side regions joined by a central pouring region. At least part of the walls of the pouring region are of arcuate form and over at least part of the depth of the mould the radii of curvature of the arcuate parts progressively increase.

9 Claims, 2 Drawing Sheets

CONTINUOUS CASTING MOULD

This invention relates to continuous casting of metal and, in particular, to a continuous casting mould for casting workpieces in the form of thin slabs.

EP-A-0149734 and U.S. Pat. No. 4,721,151 both disclose a continuous casting mould of the type to which the present invention relates. Both publications disclose a continuous casting mould having a cavity extending from the inlet end to the outlet end of the mould and the cavity has a cross-section, normal to the lengthwise direction, comprising two side regions of generally rectangular form spaced apart by a central region. In the lengthwise direction of the cavity from the inlet end thereof, the central region is enlarged to form a pouring region into which, in use, the feed tube extends.

In the European publication, the width of the central region between the two side regions is not constant and the pouring region reduces considerably in width along its length.

With such a mould, tensile strains are applied to the solid/liquid interface of the inside of the metal shell as it passes down through the mould. These tensile strains can be detrimental when their magnitude is large enough to open the grain boundaries which allows interdendritic penetration by the liquid solute which can cause detrimental segregation. These strains may also create internal cracks.

In the U.S. publication, the width of the central region between the two side regions is generally constant and the pouring region is of the same width along its length. However, the opposite walls of the pouring region which separate the side regions are constituted either entirely or partially of straight flat walls. It has been found that the use of flat walls reduces the area over which strand deformation occurs and increases the possibility of tensile stress occurring in the strand or increases the degree of compression required to cancel the tensile stress.

According to the present invention there is provided a continuous casting mould having a cavity extending in a lengthwise direction from the inlet end to the outlet end of the mould and which cavity has a cross-section, normal to the lengthwise direction, comprising two side regions of generally rectangular form spaced apart by a central region of generally constant width which does not reduce and in the lengthwise direction of the cavity from the inlet end thereof the central region is enlarged to form a pouring region; characterised in that the opposite walls of the pouring region which separate the side regions are entirely of arcuate form and over at least part of the lengthwise direction of the pouring region the radii of curvature of the arcuate walls progressively increase.

A containment zone may be positioned beneath the casting mould and the pouring region may extend into the containment zone.

Figure 1:
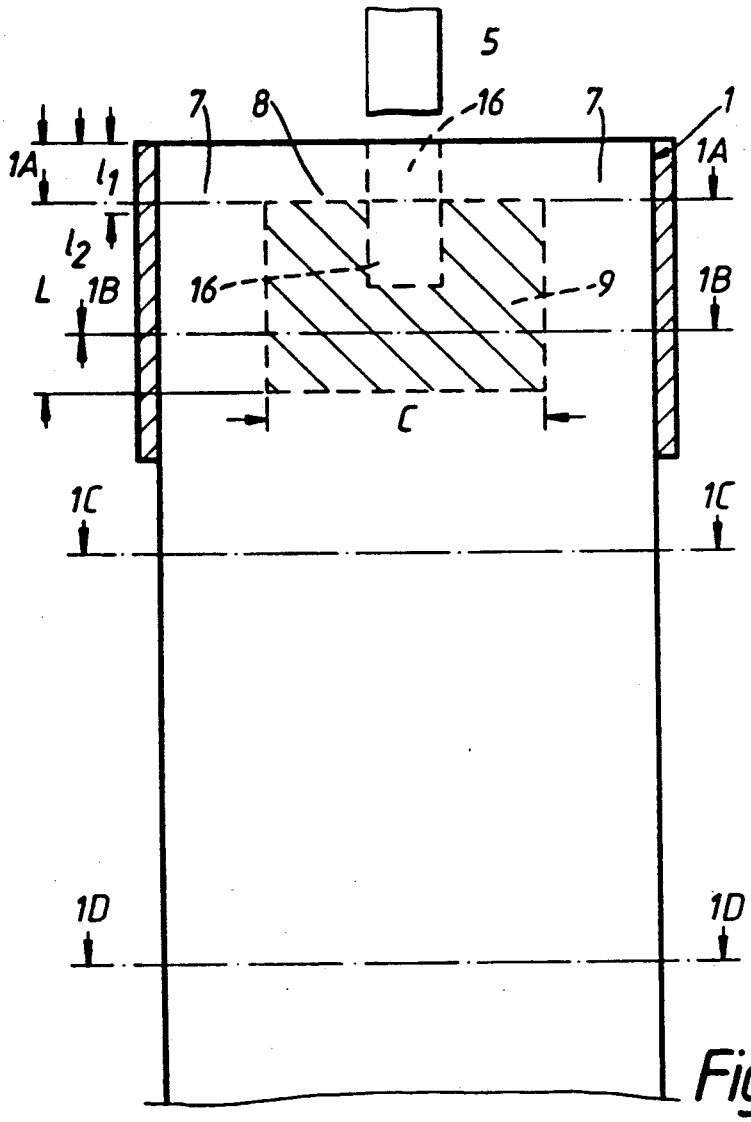
Figure 2:
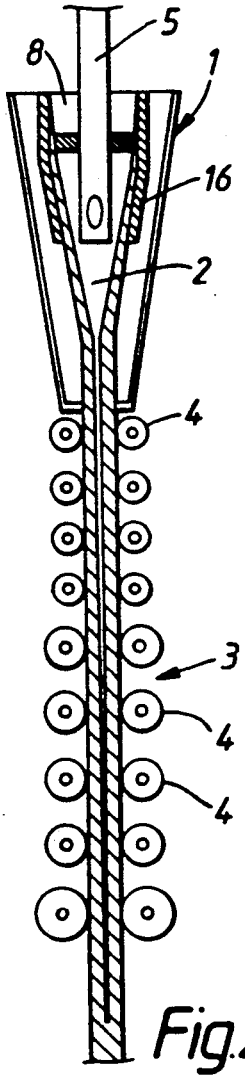
Figure 1A:
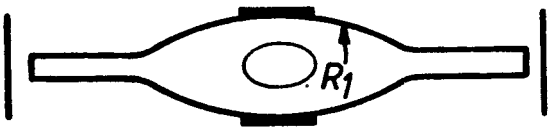
Figure 1B:
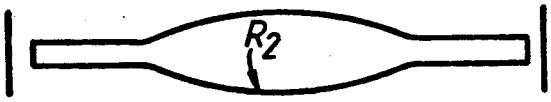
Figure 1C:
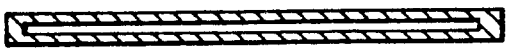
Figure 1D:
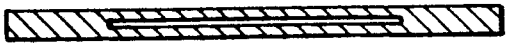
Figure 3:
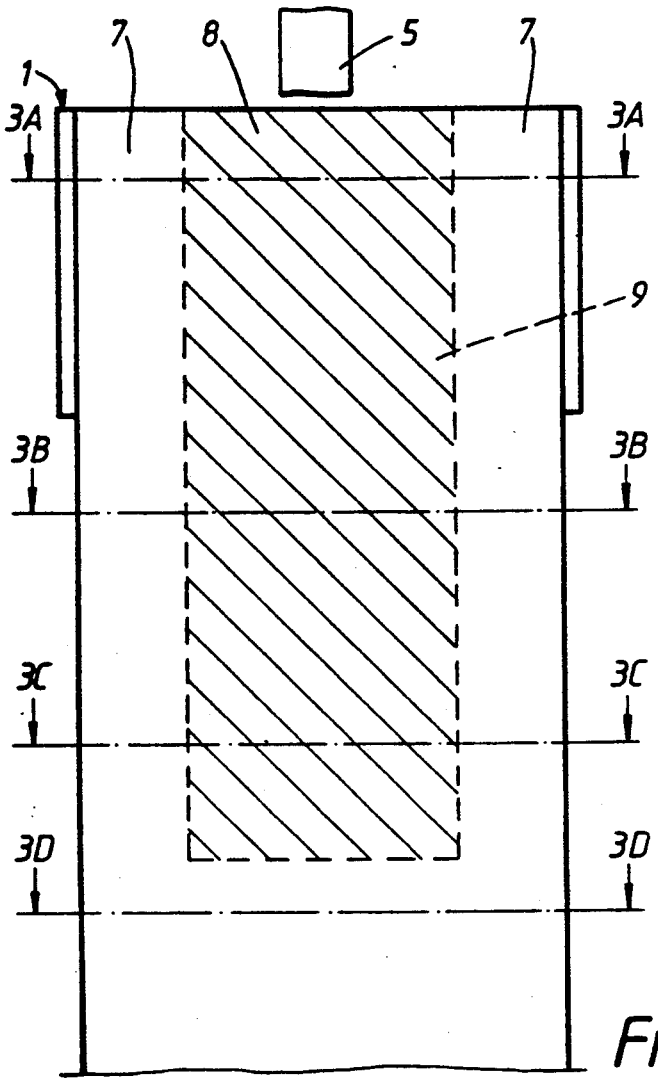
Figure 4:
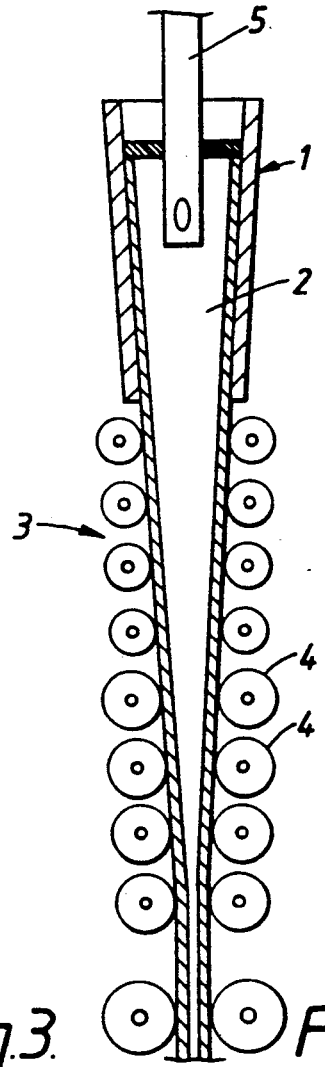
Figure 3A:
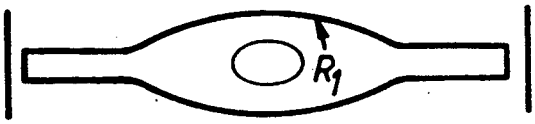
Figure 3B:
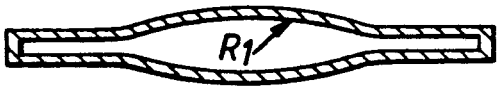
Figure 3C:
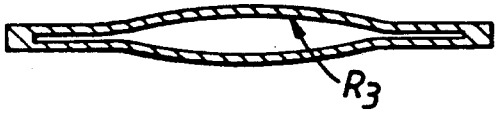
Figure 3D:
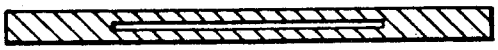

In order that the invention may be more readily understood, it will now be described, by way of example only, with reference to the accompanying drawings, in which:

FIGS. 1 and 2 are diagrammatic front and sectional side elevations, respectively, of a continuous casting mould in accordance with one embodiment of the invention;

FIGS. 1A through 1D comprise, respectively, cross sectional illustrations taken along lines 1A—1A through 1D—1D, respectively, of FIG. 1;

FIGS. 3 and 4 are diagrammatic front and sectional side elevations, respectively, of a continuous casting mould in accordance with a second embodiment of the invention;

FIGS. 3A through 3D comprise, respectively, cross sectional illustrations taken along lines 3A—3A through 3D—3D, respectively of FIG. 3; and FIG. 5 is a diagrammatic sectional side elevation of a continuous casting mould in accordance with a third embodiment of the invention.

Referring now to the figures, a continuous casting mould for casting thin metal slabs, or thick strip, is indicated by reference numeral 1. The mould is conveniently of copper alloy and it is cooled in a conventional manner by means (not shown).

In each embodiment, a mould cavity 2 extends from the inlet to the outlet end of the mould. There may be additional cavities (not shown) in the mould. The mould is oscillatable in the direction of the length of the mould cavity by means (not shown).

In use, the mould is positioned above a containment zone 3, which may consist of grids and rollers 4 and which supports the cast slab whilst it is cooled and the shell of the slab thickens. A refractory feed tube 5 extends into the inlet end of the mould cavity and molten metal passes through the tube into the mould.

In each embodiment, the cavity 2 in its widthwise direction comprises two side regions 7 which are rectangular and a central portion 8 which is of generally constant width. At the inlet end of the mould, the central region is enlarged to form a pouring region which accommodates the ceramic feed tube 5 so that adequate clearance exists between the mould walls and the outside of the tube 5. At least part of the enlarged central pouring region of the mould cavity constitutes a deformation area 9 to deform that part of the shell formed in it as the shell is moved in the direction of discharge. The deformation area is shaded in FIGS. 1 to 4. In the FIGS. 1 and 2 and the FIG. 5 embodiments it extends to a position above the bottom outlet end of the mould. In the FIGS. 3 and 4 embodiment it extends to the outlet end of the mould. The deformation area may commence at the inlet end or at a position inwardly of the inlet end.

Referring now to FIGS. 1 and 2, the centre portion 8 has walls which are of arcuate form. The arcs are of ever increasing radius R which increase to infinity at depth L. Over the distance $l_1$, from the top of the mould, the radius remains as $R_1$ but, at $l_2$, the radius $R_2$ is such that $R_2 > R_1$ whilst the length of the chord C remains constant. In practice, arc length will reduce slightly but chord length will be generally constant or with a slight increase. In this arrangement the mould discharge shape is a rectangle and the strand issuing from the mould is a rectangular solidifed shell with a liquid core, as shown by reference numeral 10. In such a system the solid/liquid interface of the strand shell is basically subjected to continuous compressive stresses at the vertical edges of the shell deformation area 9. As the shell is cooled by the mould wall it contracts setting up a stress in the outer layer. Along the bottom horizontal edge of area 9, where the radius R becomes infinitive, the stresses remain compressive as the transition from curved to flat is a gradual continuous change.

The arrangement shown in FIGS. 3 and 4 has a shell deformation area 9 which extends into the containment zone 3. The containment zone may comprise a series of rollers 4, as shown, or support grids and rollers, any of which are profiled to the radius required, i.e., $R_1$, $R_2$, $R_3$, etc., where $R_3 > R_2 > R_1$.

The metal flowing into the mould may be in liquid or solid plus liquid state. When the metal is in the solid plus liquid state, which is known as slurry, the structure will be finer with smaller grains than casting with temperature above the liquidus. A structure with such small grain size will require less mechanical working to give a suitable structure in the final product as well as eliminating the possibility of interdendritic solutes causing detrimental segregation.

The forces applied to the shell are basically compressive resulting from a uniformly distributed load on an arc or arch whose ends are constrained at the points where the ever increasing radius meets the planar narrow parallel ends. The compressive stresses are lowered as the radii of curvature are increased and the rate of change is lowered. Thus, from the meniscus, the shell in the centre portion 8 of the cavity will have two opposite vertical arcs which are continuously increasing in radius over a width which does not reduce as the strand passes through the caster. The narrow face support adjacent to the deformation zone will contain the forces resulting from the shell deformation.

In the arrangement shown in FIG. 5, the deformation zone commences at the inlet end of the mould and finishes at a position above the outlet end of the mould. The cross-section of the casting as it leaves the outlet end of the mould is rectangular with a pasty core.

Instead of totally deforming the shell to a rectangular flat shape, the strand may be allowed to totally solidify with a thicker centre section prior to either full or final deformation into a rectangular flat section equal to or less than the thickness of the narrow mould ends by rolling or forging prior to being cut into usable lengths.

The strand support below the mould may initially be configured to follow the orientation of the mould or it may be configured so that the direction of discharge is changed, e.g., the mould may be vertical and the strand support may also be vertical or it may be curved immediately below or at a discrete distance below the meniscus either inside or outside the mould.

The feed tube can be manufactured from one of a number of refractory materials. These materials have different thermal characteristics which will affect the temperature of the liquid metal adjacent to the tube and the melting of the mould lubricant, hence the surface quality of the cast product. The feed tube can also be of composite construction with different materials along its length or through its thickness. In some instances this can be a detrimental effect, especially where melting of the lubricant is inhibited or where the bridging between shell and tube may occur. In order to minimise/overcome this, the mould material is chosen such that the thermal conductivity at the area adjacent to the ceramic feed tube is different to give a different heat removal rate to other parts of the mould to enable the performance of the mould powder to remain relatively constant all around and down the mould.

For example, an insert 16 (FIG. 1) may be placed in the centre of each of the longer walls of the mould cavity, the length of the inserts being approximately equal to the length of the feed tube. The insert has a lower thermal conductivity than the remaining parts of the mould and this ensures that the metal is hotter and the shell remains thinner in the vicinity of the feed tube. The insert may be a matrix of metal such as copper with a ceramic such as silieon nitride or boron nitride impregnated in it.

The widthwise dimension of the mould cavity may be adjustable. For example, the walls of the mould which define the ends of the side regions 7 of the cavity may be movable towards and away from each other to adjust the length of the side regions and hence the width of the strand cast in the mould.

We claim:

1. A continuous casting mould having a cavity of substantially uniform width extending in a lengthwise direction from an inlet end to an outlet end of the mould, said cavity having a cross-section normal to the lengthwise direction which comprises two rectangular side regions of generally constant width and breadth separated by a central region of generally constant width; at the inlet end of the cavity, the central region constitutes a pouring region and, at the pouring region, the opposite walls of the central region which separate the side regions are of arcuate form; and for at least part of the length of the central region in the direction towards the outlet end, the radii of curvature of the arcuate walls progressively increase to reduce the breadth of the central region and constitute as deformation region which serves to deform a workpiece case in the mould as it moves therethrough in the direction towards the outlet end.

2. A continuous casting mould as claimed in claim 1, wherein the radii of curvature of the arcuate walls progressively increase from a position in the lengthwise direction from the inlet end of the mould cavity.

3. A continuous casting mould as claimed in claim 1, wherein the opposite walls of the pouring region, at least at the inlet end of the mould, include inserts of a material having a lower thermal conductivity than the material from which the remaining parts of the mould are formed.

4. A continuous casting mould as claimed in claim 3, wherein the inserts are of a copper matrix impregnated with silicon nitride or boron nitride.

5. A continuous casting mould as claimed in claim 1, wherein the widthwise dimension of the mould cavity is adjustable.

6. A continuous casting mould as claimed in claim 1, wherein means for oscillating the mould in the direction parallel to the length of the mould cavity are provided.

7. A continuous casting mould as claimed in claim 1, in combination with a containment zone having inlet and outlet ends, the inlet end of the containment zone being positioned at the outlet end of the mould, said containment zone also having a deformation region, and the deformation region of the mould being contiguous to the deformation region of the containment zone.

8. The combination claimed in claim 7, wherein the radii of curvature of the walls of the workpiece in the deformation region in the containment zone increase to infinity at a position above the outlet end of the containment zone.

9. A continuous casting mould as claimed in claim 1, wherein, from a first position in the lengthwise direction from the inlet end of the mould cavity, the curvature of the arcuate walls progressively increase to infinity at a second position which is between a first position and the outlet end of the mould cavity.

* * * * *